US012687165B2

(12) United States Patent
Scanlon et al.

(10) Patent No.: US 12,687,165 B2
(45) Date of Patent: Jul. 21, 2026

(54) PUMP WITH CONDUIT SYSTEM FLUIDLY COUPLED TO CYLINDERS

(71) Applicant: Ingersoll-Rand Industrial U.S., Inc., Davidson, NC (US)

(72) Inventors: Brian James Scanlon, Statesville, NC (US); Daniel Brocker, Cornelius, NC (US); Willem Kuyvenhoven, Davidson, NC (US)

(73) Assignee: INGERSOLL-RAND INDUSTRIAL U.S., INC., Davidson, NC (US)

( * ) Notice: Subject to any disclaimer, the term of this patent is extended or adjusted under 35 U.S.C. 154(b) by 0 days.

(21) Appl. No.: 19/047,533

(22) Filed: Feb. 6, 2025

(65) Prior Publication Data

US 2025/0257728 A1 Aug. 14, 2025

Related U.S. Application Data

(60) Provisional application No. 63/553,371, filed on Feb. 14, 2024.

(51) Int. Cl.

| | |
|---|---|
| ***F04B 53/16*** | (2006.01) |
| ***F04B 1/0421*** | (2020.01) |
| ***F04B 43/02*** | (2006.01) |
| ***F04B 53/00*** | (2006.01) |
| ***F04B 53/06*** | (2006.01) |

(52) U.S. Cl.
CPC ..... *F04B 53/16* (2013.01); *F04B 1/0421* (2013.01); *F04B 43/026* (2013.01); *F04B 53/006* (2013.01); *F04B 53/06* (2013.01)

(58) Field of Classification Search
CPC ..... F04B 1/04; F04B 43/026; F04B 53/06
See application file for complete search history.

(56) References Cited

U.S. PATENT DOCUMENTS

| | | | | |
|---|---|---|---|---|
| 6,447,216 | B1 * | 9/2002 | Higuchi | F04B 43/0736 406/73 |
| 2005/0152787 | A1 | 7/2005 | Oglesby | |
| 2006/0159565 | A1 | 7/2006 | Sanwald | |
| 2008/0193299 | A1 * | 8/2008 | Oglesby | F04B 53/02 417/442 |
| 2020/0291936 | A1 | 9/2020 | Brocker et al. | |

OTHER PUBLICATIONS

Extended European Search Report in counterpart European Application No. 25157527.0, mailed May 7, 2025, 12 pages.

* cited by examiner

*Primary Examiner* — Kenneth J Hansen
(74) *Attorney, Agent, or Firm* — Edell, Shapiro & Finnan, LLC

(57) ABSTRACT

A pump includes a cylinder and a piston disposed within the cylinder to define a first chamber and a second chamber within the cylinder. The piston is configured to move within the cylinder to reduce a size of the first chamber to discharge material from the first chamber. The pump also includes a conduit system configured to direct fluid into the first chamber to aerate material in the first chamber.

19 Claims, 12 Drawing Sheets

PUMP WITH CONDUIT SYSTEM FLUIDLY COUPLED TO CYLINDERS

CROSS-REFERENCE TO RELATED APPLICATION

This patent application claims priority to and the benefit of, and is a non-provisional application of, U.S. Patent App. No. 63/553,371, filed Feb. 14, 2024, entitled "PUMP WITH CONDUIT SYSTEM FLUIDLY COUPLED TO CYLINDERS", the entire disclosure of which is incorporated by reference herein in its entirety.

TECHNICAL FIELD

The present disclosure is directed to pumps and more specifically to a pump with a conduit system that fluidly couples cylinders to one another to direct fluid (e.g., gas) between the cylinders.

BACKGROUND

Pumps can be used to drive movement of certain materials. For example, the pump may include multiple cylinders, as well as pistons movable within each cylinder. Movement of the pistons within their respective cylinders directs materials through the cylinders. In some embodiments, the material being directed includes a powdered material. Unfortunately, powdered material is susceptible to settling within the cylinder, and settling of the powdered material may obstruct or choke a flow of the powdered material and/or impede movement of the pistons. Thus, settling of the powdered material may reduce an efficiency or an effectiveness of operation of a pump moving powdered material.

SUMMARY

In one embodiment, the present application is directed to a pump. The pump includes a cylinder and a piston disposed within the cylinder to define a first chamber and a second chamber within the cylinder. The piston is configured to move within the cylinder to reduce a size of the first chamber to discharge material from the first chamber. The pump also includes a conduit system configured to direct fluid into the first chamber to aerate material in the first chamber.

BRIEF DESCRIPTION OF THE DRAWINGS

To complete the description and provide a better understanding of the present disclosure, a set of drawings is provided. The drawings form an integral part of the description and illustrate an embodiment of the present disclosure, which should not be interpreted as restricting the scope of the disclosure, but just as an example of how the disclosure can be carried out.

Like numerals have been used throughout the Figures.

DETAILED DESCRIPTION

Figure 1:
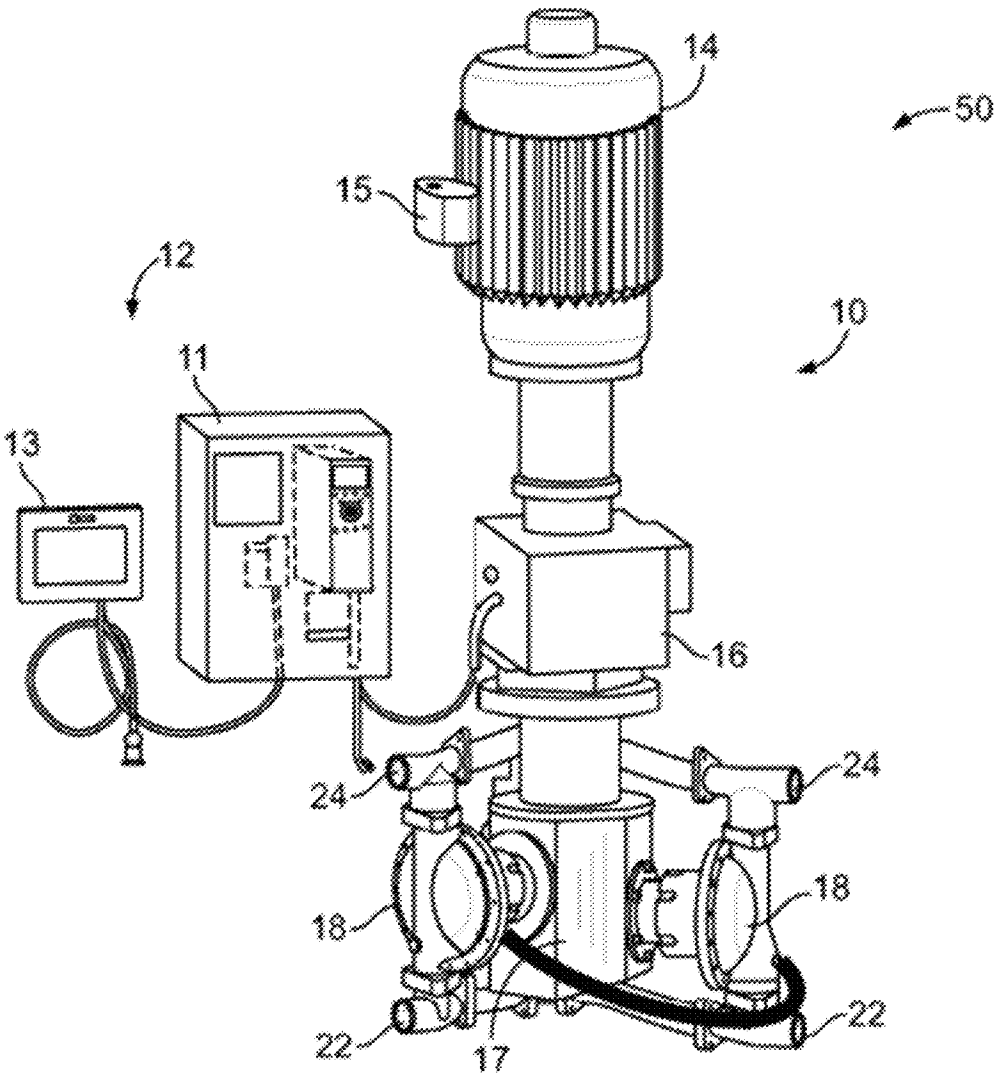
FIG. 1 is a perspective side view of a pump system, in accordance with an embodiment of the present disclosure.

The present disclosure is directed to directing fluid (e.g., gas) between cylinders of a pump system to aerate material within the cylinders. It is to be understood that particulate, such as powdered material, may be present in the fluid that is directed between cylinders of a pump system. In other words, the fluid that is directed is not solely a fluid, such as a gas. Operation of the pump system drives movement of the material into and out of the cylinders. For example, each cylinder of the pump system defines a chamber, and movement of a piston within the chamber draws material into the chamber and directs material out of the chamber, such as at a desirable speed and/or pressure. By way of example, the material driven by the pump system includes a powdered material that contains small, solid particles.

Unfortunately, powdered material may settle within the chambers. Settled powdered material may be relatively more difficult to move via the pistons. For example, the settled powdered material may adhere to the walls of the cylinder and may be difficult to remove it from the walls with pumping pressure. The adhered powder may then increase friction in the chamber, reducing the effectiveness of the pump, further diminishing pumping effectiveness. Thus, a substantial portion of the powdered material may remain within the chambers instead of being directed out during movement of the pistons. For this reason, settling of the powdered material in the chambers may reduce an efficiency of operation of the pump system to direct the powdered material. Additionally or alternatively, powdered material may adhere with one another and compact. Consequently, during operation of the pump, the compacted powdered material may impact and collide with the pump to impart an excessive amount of force onto the pump, thereby affecting a structural integrity of the pump and of other components of the pump system (e.g., the cylinder wall against which the pump may move the powdered material) and potentially reducing a useful lifespan of the pump system.

Increasing movability of the powdered material may improve efficiency of operation of the pump system and/or increase a useful lifespan of the pump system. Therefore, in accordance with embodiments of the present disclosure, the pump includes a conduit system configured to aerate and/or agitate the powdered material within the chambers to prevent or at least discourage settling of the powdered material in the cylinders. For instance, the pump may include a first cylinder and a first piston disposed in the first cylinder to define a first pumping chamber and a first containment chamber. The pump may also include a second cylinder and a second piston disposed in the second cylinder to define a second pumping chamber and a second containment chamber. The first piston is configured to move within the first cylinder to discharge powdered material from the first pumping chamber, and the second piston is configured to move within the second cylinder to discharge powdered material from the second pumping chamber.

Movement of the first piston to draw powdered material into the first pumping chamber reduces a size of the first containment chamber to direct fluid from the first containment chamber to the second pumping chamber via the conduit system. The fluid directed into the second pumping chamber aerates the powdered material in the second pumping chamber to improve movability of the powdered material. As an example, the fluid causes the powdered material to be suspended within the second pumping chamber instead of adhering to the cylinder in the second pumping chamber. As such, the powdered material is more readily movable such that movement of the second piston can more efficiently discharge the powdered material from the second pumping chamber. That is, powdered material may flow more easily through the pump system and avoid compacting and/or settling. For this reason, the conduit system directing fluid flow from the first containment chamber to the second pumping chamber may improve operation of the pump and maintain a desirable structural integrity of the pump. Although the present disclosure primarily discusses usage of fluid to facilitate movement of powdered material, it should be noted that fluid may be directed between cylinders to facilitate movement of any other suitable material, including a fluid that does not contain substantial amounts of solid material.

FIG. 1 is a perspective side view of a pump system 50. The pump system 50 includes, among other components, a diaphragm pump 10 that is operably coupled to a control system 12 and a drive or driver 14. While embodiments discussed herein are primarily discussed in terms of diaphragm pump systems, at least certain features can also be applicable to a variety of other types of pump systems, including, but not limited to, other types of pumps and positive displacement pumps.

According to certain embodiments, the control system 12 can include, for example, an external embedded controller 11 that is communicatively coupled to a human-machine interface 13, among other components. The external controller 11 is configured to automate the operation of the diaphragm pump 10. For example, the external controller 11 can be configured to correlate speed of a driver 14, such as, for example, a motor speed, with a flow rate of a material being pumped by the diaphragm pump 10. The external controller 11 can also include an override for extended periods of a stall event. Further, the control system 12 may be optional to supplement a motor drive, such as a variable frequency drive (VFD) 15 that is configured to operate the driver 14.

Figure 4:
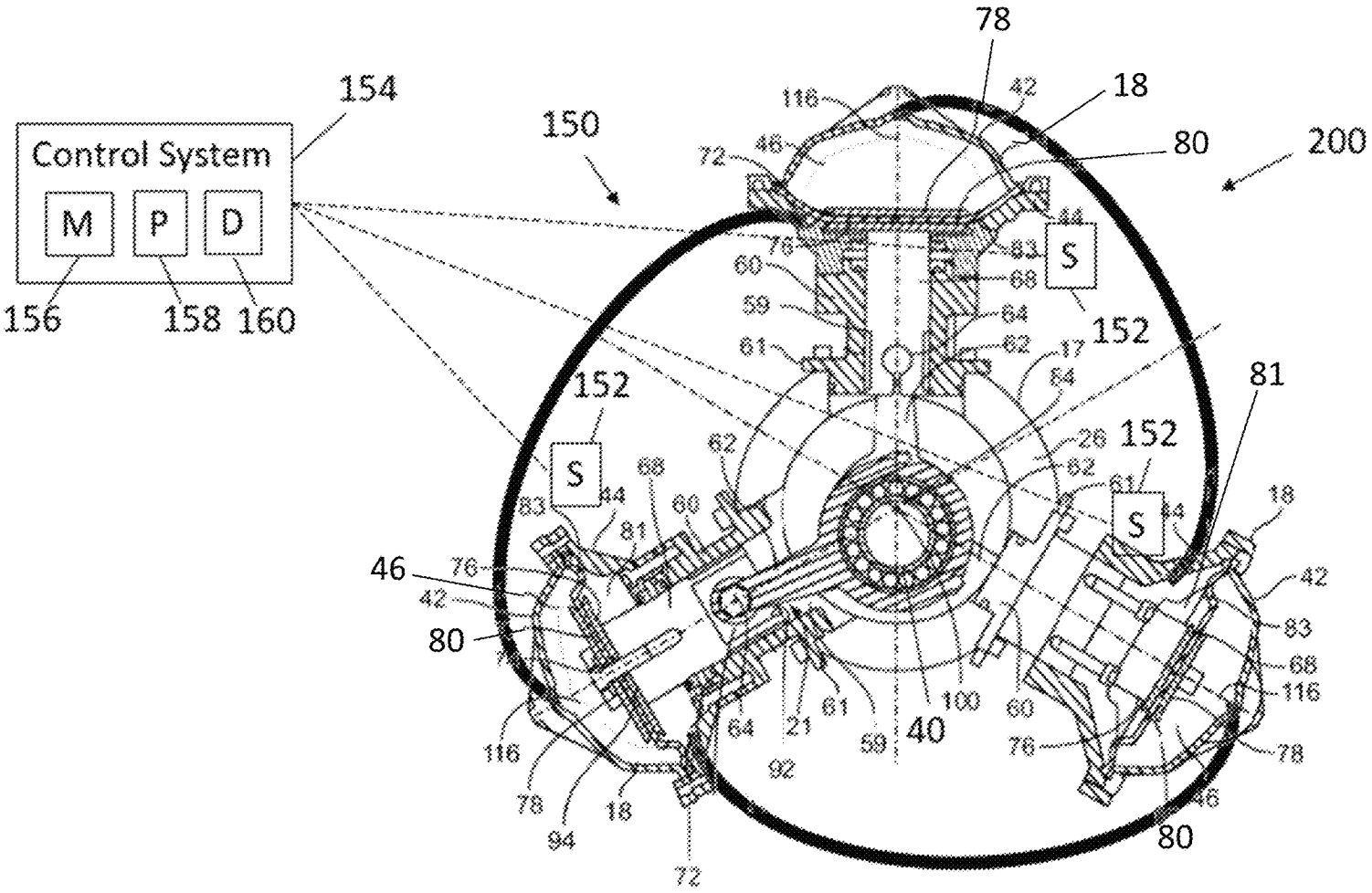
FIG. 4 is a cross-sectional view of the pump drive system of FIG. 3.

As shown in at least FIG. 1, the diaphragm pump 10 is mechanically coupled to the driver 14. The driver 14 is operably coupled to a timing device with a mechanical output, such as a crankshaft, 40 (FIG. 2) of the pump system 50 such that operation of the driver 14 facilitates rotational displacement of at least the crankshaft 40 about a crankshaft axis (or "rotational axis") 100 (FIG. 4). Further, as shown in at least FIG. 1, according to certain embodiments, operable coupling of the driver 14 to the crankshaft 40 includes a gearbox 16 that is configured to adjust and/or control the relative speeds and torque transmitted from the driver 14 to the crankshaft 40.

The diaphragm pump 10 includes a crankcase 17 and a plurality of cylinders 18. During operation of the pump system 50, the diaphragm pump 10 directs powdered material into and out of each cylinder 18. For example, referring to FIGS. 1 and 2, powdered material can enter each cylinder 18 through an inlet 22, and powdered material can exit each cylinder 18 through an outlet 24. The driver 14 may drive rotation of the crankshaft 40 to direct the powdered material in a particular manner, such as at a particular speed and/or at a particular pressure.

The diaphragm pump 10 also includes a conduit system 150 extending between the cylinders 18. The conduit system 150 is configured to direct a fluid, such as air (e.g., compressed air), between the cylinders 18. The fluid flow between the cylinders 18 may aerate or agitate the powdered material within the cylinders 18 to prevent or at least discourage settling of the powdered material within the cylinders 18, thereby facilitating movement of the powdered material through the cylinders 18. Thus, the conduit system 150 may improve operation of the pump system 50.

Figure 2:
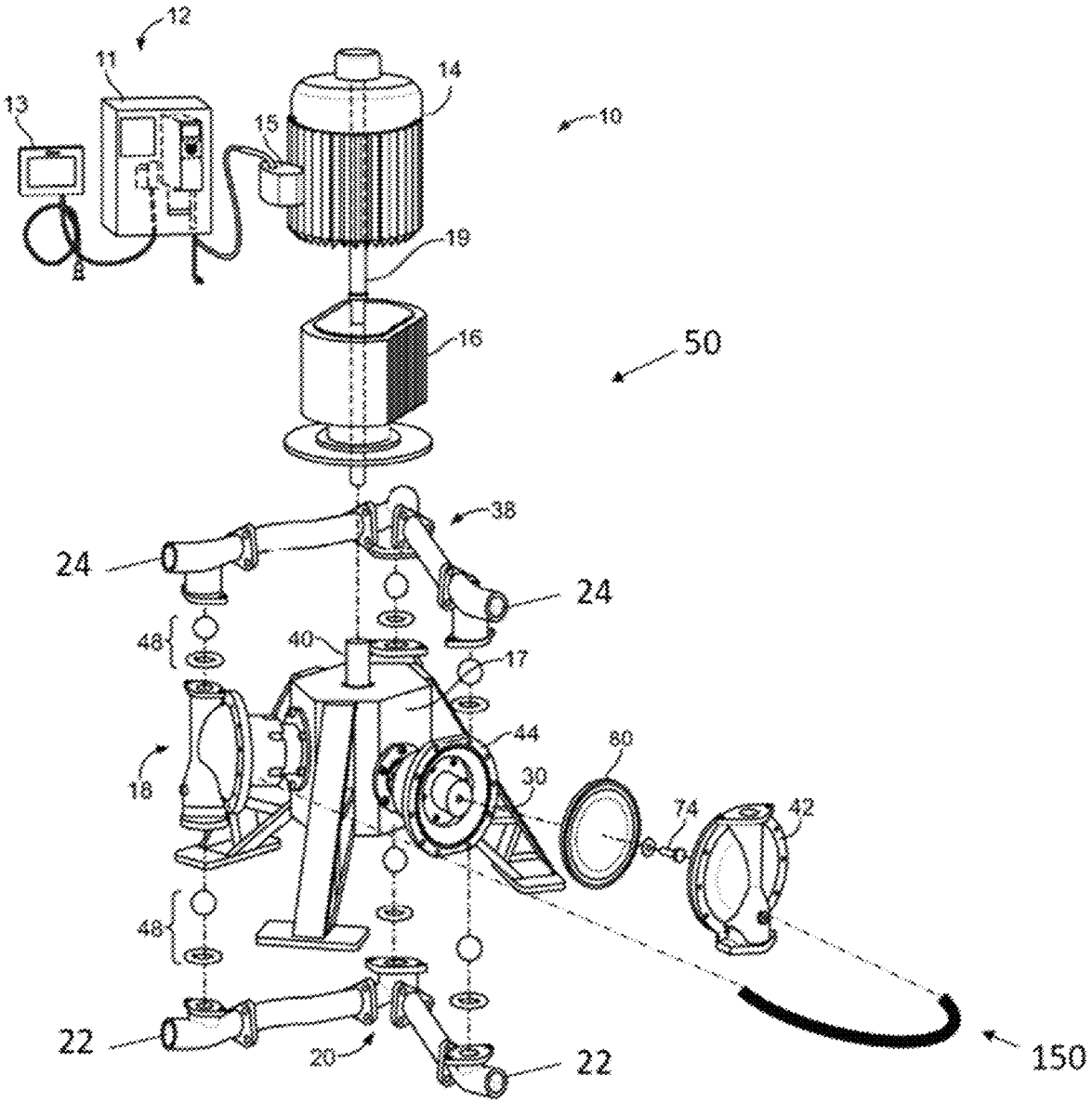
FIG. 2 is an exploded view of the pump system of FIG. 1.

FIG. 2 is an exploded view of the pump system 50 that includes the diaphragm pump 10 with an associated stand 30. The pump system 50 includes a common inlet manifold 20 and a common outlet manifold 38, among other components. The common inlet manifold 20 introduces powdered material into the cylinders 18 via the inlets 22, and the common outlet manifold 38 directs the powdered material out of the cylinders 18 via the outlets 24. The crankshaft 40 protrudes from the crankcase 17 and is coaxially coupled with a drive shaft 19 of the driver 14 to direct the powdered material through the cylinders 18. While three cylinders 18 are primarily provided herein, any quantity of cylinders 18 can be implemented in additional or alternative embodiments.

According to at least certain embodiments, each of the cylinders 18 can have generally similar components. For example, each cylinder 18 can include an outer housing 42 (e.g., a fluid cap), an inner housing 44, and a diaphragm 80 positioned between the outer housing 42 and the inner housing 44. In the depicted embodiment, each diaphragm 80 is secured within its cylinder 18 via a mechanical fastener 74, such as a bolt. Other couplings may be used to secure the diaphragms in other embodiments. The conduit system 150 is coupled to the outer housing 42 and to the inner housing 44 of each of the cylinders 18.

Additionally, according to certain embodiments, one-way check valves 48 can be functionally positioned proximate to both the inlet 22 and the outlet 24 of each of the cylinders 18. While a variety of types of one-way check valves can be utilized, according to certain embodiments, the one-way check valves 48 are ball valves. In some embodiments, such ball valves may be gravity operated. In additional or alternative embodiments, the one-way check valves 48 may include a biasing element, such as a spring, among other forms of biasing elements.

Figure 3:
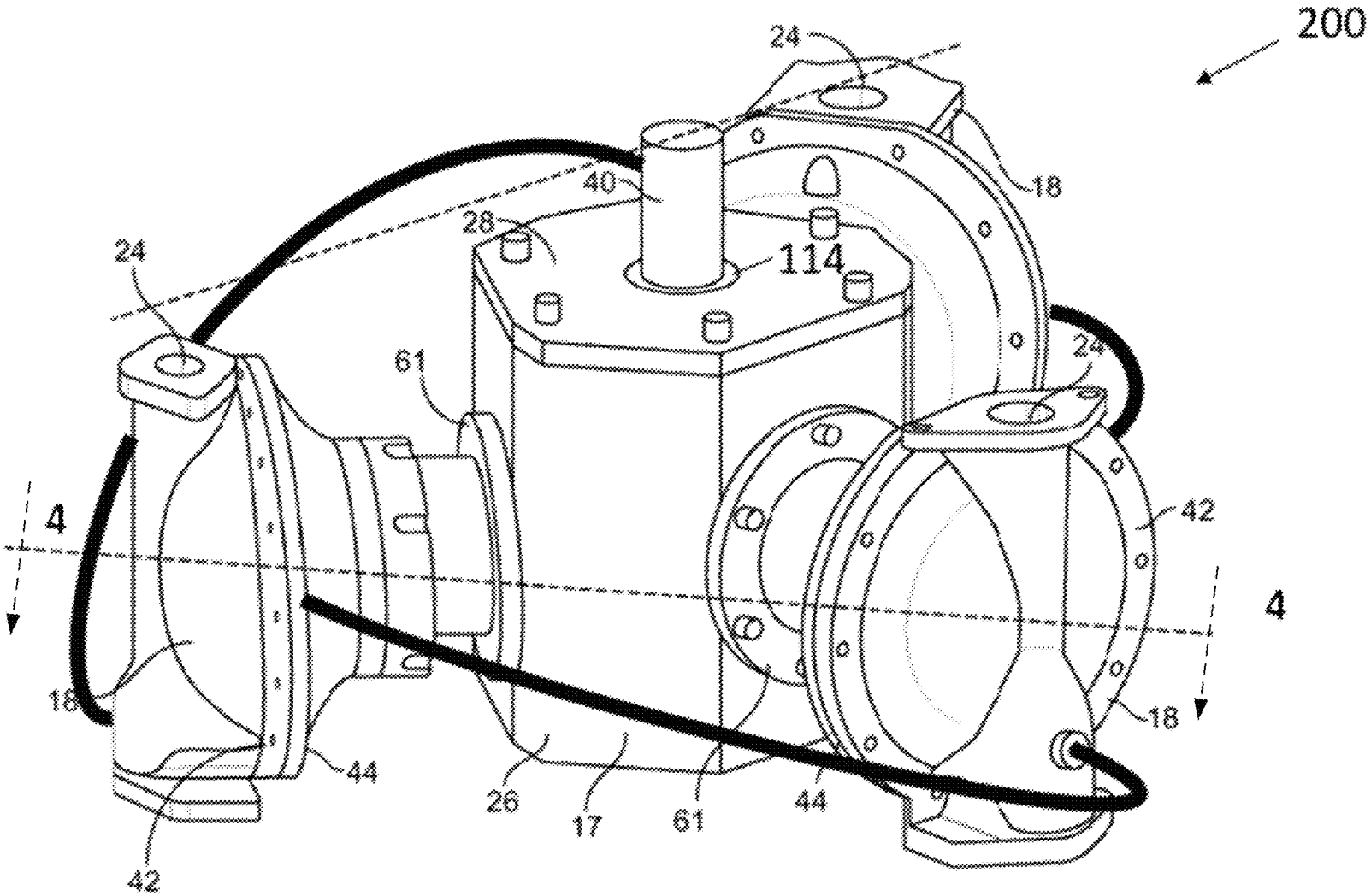
FIG. 3 is a perspective side view of a pump drive system of a pump system, in accordance with an embodiment of the present disclosure.

FIG. 3 is a perspective side view of a pump drive system 200 of the diaphragm pump 10. As shown in FIG. 3, the crankcase 17 includes a lower crankcase 26 and an upper crankcase 28. Each cylinder 18 is mounted to the lower crankcase 26 via a shoulder 61. The crankshaft 40 extends from the upper crankcase 28, and the upper crankcase 28 includes a seal 114 that extends around a portion of the crankshaft 40 to sealingly engage the upper crankcase 28 with the crankshaft 40. Also shown in FIG. 3 are the outlets 24, the outer housings 42, and the inner housings 44 for cylinders 18.

FIG. 4 is a cross-sectional view of the pump drive system 200 taken along line 4-4 in FIG. 3. As shown in FIG. 4, each outer housing 42 defines at least a portion of a pumping chamber 46 of its respective cylinder 18. The pumping chamber 46 is in fluid communication with the inlet 22 and the outlet 24 of the respective cylinder 18. As such, powdered material enters the pumping chamber 46 via the inlet 22 and exits the pumping chamber 46 via the outlet 24. Further, each diaphragm 80 within its cylinder 18 is coupled to an adjacent piston 68 of a slider crank mechanism 21. In addition to a plurality of pistons 68, the illustrated slider crank mechanism 21 includes connecting rods 62 coupled to the pistons 68. The connecting rod 62 extends from the piston 68 to connect to the crankshaft 40, such as by a bearing ring or journal bearing 84. Such connection between the connecting rods 62 and the crankshaft 40 enables movement (e.g., rotation) of the crankshaft 40 to drive movement of the connecting rods 62 and therefore movement of the pistons 68 coupled to the connecting rods 62. For instance, rotation of the crankshaft 40 causes each piston 68 to move reciprocally (e.g., back and forth) within a corresponding piston housing 60 extending between the crankcase 17 and the inner housing 44 to drive corresponding movement of the diaphragm 80 in the particular cylinder 18.

At least certain components of the slider crank mechanism 21 that are associated with a particular cylinder 18 have the same configuration as other similar components of the slider crank mechanism 21 that are associated with another cylinder 18. For instance, each of the piston 68, the piston housing 60, and/or the connecting rod 62 of the slider crank mechanism 21 that is used with a particular cylinder 18 can have similar configuration and features as a similar component that is used with another cylinder 18. Indeed, similar elements and associated features for those elements can exist for each of the cylinders 18 and the associated slider crank mechanism 21, whether or not such similar elements and features are actually viewable in certain drawings of this disclosure. Notably, since the cylinders 18 of the embodiments depicted in FIG. 4 are longitudinally (e.g., vertically) offset, different portions of each cylinder 18 are visible in FIG. 4.

Operation of the slider crank mechanism 21 and movement of the crankshaft 40 causes each piston 68 to reciprocate along a piston axis that extends through a cylinder bore 59 of the piston housing 60. Each piston 68 extends between a first end 92 that is coupled to one of the connecting rods 62 and a second end 94 that is coupled to one of the diaphragms 80. Thus, reciprocation of the pistons 68 along the piston axes drives movement of the diaphragms 80 within the cylinders 18. The portion of each piston 68 proximate to the crankcase 17, namely the first end 92 of the piston 68, includes a wrist pin cavity in which a wrist pin 64 is positioned that attaches the piston 68 to the connecting rod 62.

A corresponding cylinder axis 116 extends through the center of each cylinder 18. Each cylinder axis 116 for the cylinders 18 is perpendicular to the crankshaft axis 100 of the crankshaft 40, and the cylinder axes 116 are distributed circumferentially around the crankshaft axis 100. However, in additional or alternative embodiments, the cylinder axes 116 may be oriented in a different manner relative to the crankshaft axis 100, such as extending along (e.g., parallel to) the crankshaft axis 100. Each piston 68 is configured to move along a corresponding cylinder axis 116. That is, the piston axis along which each piston 68 reciprocates is aligned with the corresponding cylinder axis 116. In some embodiments, the cylinders 18 are offset from one another along the crankshaft axis 100. That is, the cylinder axes 116 are offset from one another along the crankshaft axis 100. Thus, each piston 40 is connected to a different portion of the crankshaft 40.

Movement of the pistons 68 within the cylinders 18 causes the diaphragms 80 to change a volume, and thus a pressure, within their respective pumping chamber 46. For instance, each diaphragm 80 may be coupled to the outer housing 42 and/or to the inner housing 44 via an annular flexible portion 83, which can flex to adjust the positioning of the diaphragms 80 within the cylinder 18, thereby changing the volume within the pumping chamber 46. The change in volume effectuated by the diaphragms 80 may move powdered material into and out of the pumping chambers 46. For example, displacing or flexing at least a portion of the diaphragm 80 (e.g., via the annular flexible portion 83) to increase a volume and therefore decrease a pressure within the pumping chamber 46 may draw powdered material into the pumping chamber 46 through an inlet 22. Additionally, displacement or flexing of the diaphragm 80 (e.g., via the annular flexible portion 83) to decrease the volume of the pumping chamber 46 and therefore increase a pressure within the pumping chamber 46 may force at least a portion of the powdered material out of the pumping chamber 46 through an outlet 24.

The diaphragm 80 within the cylinder 18 can be designed as a replaceable wear component. For example, in the illustrated embodiment, the diaphragm 80 is mechanically coupled to the second end 94 of an associated piston 68 via a mechanical fastener 74. The mechanical fastener 74 extends through an inner washer 76 and an outer washer 78 that are positioned on, and support, opposing sides of the diaphragm 80. By way of example, the radially inner portion of diaphragm 80 can be secured between the inner washer 76 and the outer washer 78. The washers 76 and 78 are configured to provide stabilizing and rigid support to at least the adjacent portion of the diaphragm 80. Additionally, the annular flexible portion 83 extends radially outward from the washers 76 and 78 and can be securely fitted between opposing sealing surfaces of the inner housing 44 and the outer housing 42. In additional or alternative embodiments, either or both of the washers 76 and 78 may be integrated into the diaphragm 80 to form a monolithic structure.

The illustrated embodiment includes a containment chamber 81 defined on the backside of each diaphragm 80. Each diaphragm 80 provides a seal that fluidly separates a containment chamber 81 and a corresponding pumping chamber 46 from one another. During operation of the pump drive system 200, the containment chamber 81 includes a fluid, such as ambient air and/or a dedicated process fluid. The conduit system 150 fluidly couples the containment chamber 81 of one of the cylinders 18 with the pumping chamber 46 of another of the cylinders 18. Thus, fluid may pass between the cylinders 18. For instance, during an intake stroke in which a diaphragm 80 is forced axially toward the crankcase 17, the volume of the containment chamber 81 is reduced to force fluid out of the containment chamber 81 and into the conduit system 150. The conduit system 150 then directs the fluid to the pumping chamber 46 of another cylinder 18. As a result, the fluid may interact with the powdered material in the pumping chamber 46 of the other cylinder 18 to aerate the powdered material, thereby discouraging settling of the powdered material within the other cylinder 18. As a result, movement of the piston 68 within the other cylinder 18 (e.g., to reduce a volume of its pumping chamber 46) may direct the powdered material out of the other cylinder 18 more effectively.

Moreover, the containment chamber 81 is substantially sealed from a lubricant bath that is within at least a portion of the crankcase 17, such as, for example, lubricant that is within the crankcase 17 and is utilized to reduce wear and distribute heat of the crankshaft 40 and the connecting rods 62. A seal assembly 72 bears against the outer surface of the piston 68. The seal assembly 72 can include, for example, one or more oil facing seals and one or more containment chamber facing seals including, but not limited, to bellows seals and bi-directional seals. According to certain embodiments, the containment chamber facing seal can be a bellow design (not shown) that spans between the second end 94 of the piston 68 and the piston housing 60. The seal assembly 72 is configured and positioned to prevent or discourage lubricant from mixing with fluid in the containment chamber 81.

Furthermore, sensors 152 are used to monitor amounts of powdered material in the containment chambers 81. For example, presence of powdered material in the containment chambers 81 may indicate leakage of powdered material through the diaphragms 80 (e.g., caused by an undesirable change in structural integrity of the diaphragms 80). Thus, the sensors 152 may be used to determine whether operation of the pump drive system 200 is desirable to direct powdered material and avoid buildup of powdered material in the containment chambers 81. By way of example, the sensors 152 may include optical sensors configured to visually determine a presence of powdered material in the containment chambers 81 (e.g., by capturing an image within the containment chambers 81). However, any other suitable type of sensors 152 may be utilized to monitor a parameter, such as a weight, indicative of presence of powdered material in the containment chambers 81. In certain embodiments, a control system 154 is communicatively coupled to the sensors 152. The control system 154 includes a memory 156 and a processor 158 (e.g., processing circuitry). The memory 156 includes read only memory (ROM), random access memory (RAM), magnetic disk storage media devices, optical storage media devices, flash memory devices, electrical, optical, or other physical/tangible (e.g., non-transitory) memory storage devices. Thus, in general, the memory 156 includes one or more computer-readable storage media (e.g., a memory device) encoded with software with computer executable instructions that may be executed to effectuate the operations described herein. The processor 158 includes a collection of one or more microcontrollers and/or microprocessors, for example, each configured to execute respective software instructions stored in the memory 156. The processor 158 is configured to, for example, execute the instructions stored in the memory 156 to operate the pump drive system 200.

For instance, the control system 154 may receive data from the sensors 152 and determine an amount of powdered material in the containment chambers 81 based on the data. In response to a determination that the amount of powdered material in the containment chambers 81 is above a threshold amount (e.g., to indicate sufficient leakage of powdered material), the control system 154 may output a signal. As an example, the signal may provide a notification, such as a visual output (e.g., via a display 160), an audio output, and/or a notification sent to a user device. Thus, the signal may prompt a user to inspect the pump drive system 200 and address buildup of powdered material in the containment chambers 81. As another example, the signal may suspend or reduce operation of the pump drive system 200 to avoid further leakage of powdered material into the containment chambers 81.

Figure 5:
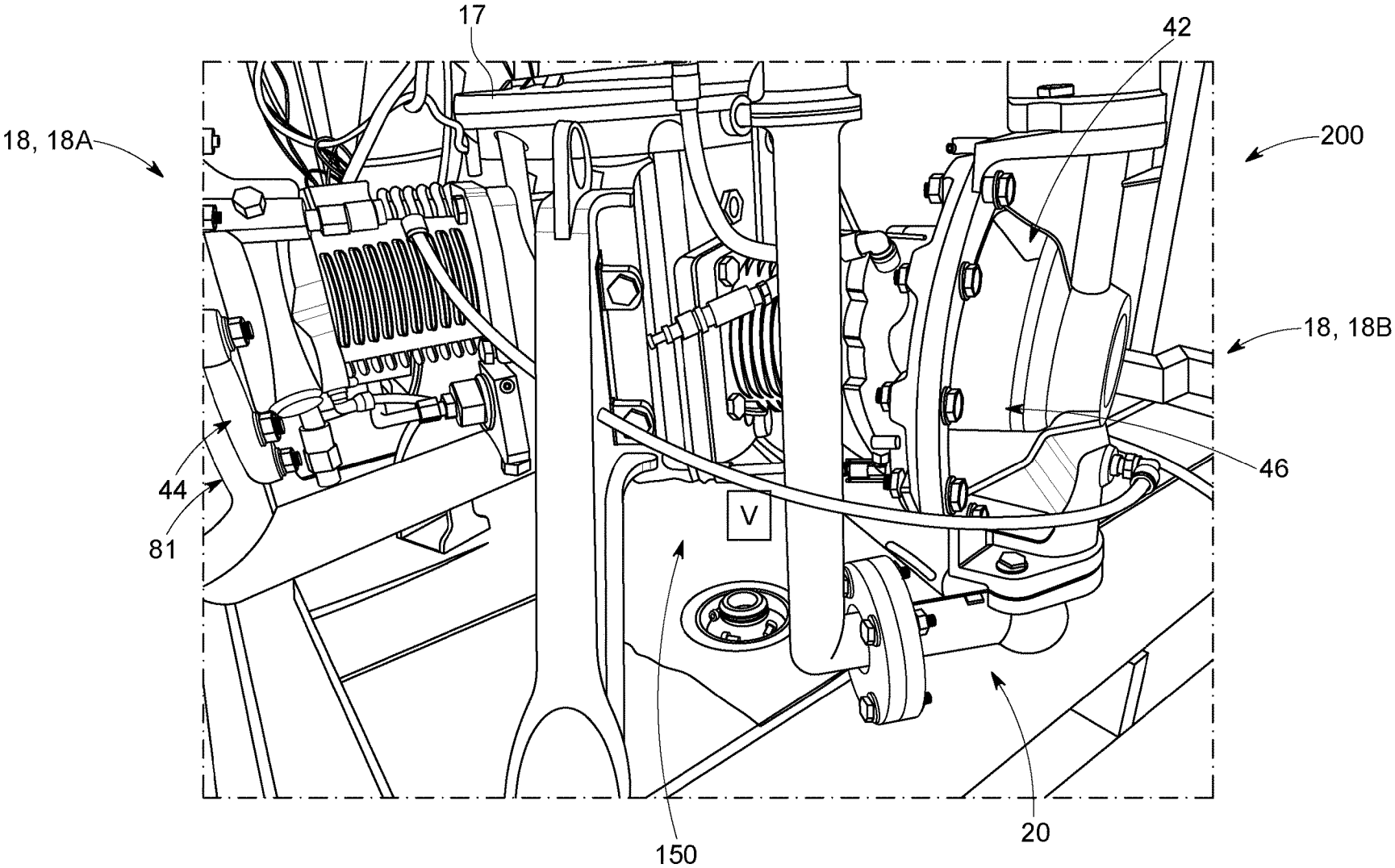
FIG. 5 is a perspective view of the pump drive system of FIG. 3.

FIG. 5 is a perspective side view of the pump drive system 200 illustrating a first cylinder 18A fluidly coupled to a second cylinder 18B via the conduit system 150. In particular, a conduit of the conduit system 150 is fluidly coupled to the containment chamber 81 of the first cylinder 18A and to the pumping chamber 46 of the second cylinder 18B. More specifically, a first end of the conduit is coupled to an opening of the inner housing 44 of the first cylinder 18A and a second end of the conduit is coupled to an opening of the outer housing 42 of the second cylinder 18B. Thus, axial movement (e.g., translation) of the piston 68 in the first cylinder 18A toward the crankcase 17, as effectuated by the driver 14, reduces the volume of the containment chamber 81 of the first cylinder 18A and drives fluid flow from the containment chamber 81. This fluid flow moves through the conduit and into the pumping chamber 46 of the second cylinder 18B. Consequently, the fluid may aerate powdered material within the pumping chamber 46 of second cylinder 18B to allow the piston 68 in the second cylinder 18B to efficiently pump powdered material. For example, axial movement of the piston 68 in the second cylinder 18B away from the crankcase 17 may discharge the aerated powdered material more efficiently from the pumping chamber 46 of the second cylinder 18B than embodiments without aeration/agitation. In some embodiments, such movement of the piston 68 in second cylinder 18B may also drive movement of the fluid received from the conduit out of the pumping chamber 46. That is, a mixture of the powdered material and the fluid may be discharged out of the pumping chamber 46.

In the illustrated embodiment, the conduit is coupled to the outer housing 42 at a portion (e.g., a lower portion) coupled to the common inlet manifold 20. Thus, the conduit is positioned adjacent to the inlet 22, which is configured to direct powdered material into the pumping chamber 46. Accordingly, powdered material directed into the pumping chamber 46 via the inlet 22 may immediately be aerated by the fluid directed from the conduit as it enters pumping chamber 46 to avoid settling of the powdered material.

In some embodiments, as described above, a first one-way valve (e.g., a first check valve) may be implemented at the conduit between the pumping chamber 46 of the second cylinder 18B and the containment chamber 81 of the first cylinder 18A. For instance, the first one-way valve may be positioned at a first end of the conduit adjacent to the pumping chamber 46 of the second cylinder 18B or at a second end of the conduit adjacent to the containment chamber 81 of the first cylinder 18A. The first one-way valve blocks flow of fluid from the pumping chamber 46 of the second cylinder 18B toward the containment chamber 81 of the first cylinder 18A, thereby forcing fluid flow from the containment chamber 81 of the first cylinder 18A to the pumping chamber 46 of the second cylinder 18B. The first one-way valve may also prevent or at least discourage powered material from exiting the pumping chamber of one cylinder and moving into the containment chamber of another cylinder. Thus, the first one-way valve improves fluid flow to aerate powdered material in the pumping chamber 46.

Additionally or alternatively, a second one-way valve (e.g., a second check valve) may be implemented on the first cylinder 18A to enable flow of fluid into the containment chamber 81 of the first cylinder 18A and block flow of fluid from the containment chamber 81 of the first cylinder 18A into a surrounding environment (e.g., an ambient environment, an external environment). Thus, during a discharge stroke in which the volume of the containment chamber 81 of the first cylinder 18A is increased, fluid is directed from the surrounding environment into the containment chamber 81 of the first cylinder 18A. Similarly, a third one-way valve (e.g., a third check valve) may be implemented on the second cylinder 18B to enable flow of fluid into the containment chamber 81 of the second cylinder 18B and block flow of fluid from the containment chamber 81 of the second cylinder 18B into the surrounding environment. As such, a discharge stroke that increases the volume of the containment chamber 81 of the second cylinder 18B directs fluid from the surrounding environment into the containment chamber 81 of the second cylinder 18B.

In some embodiments, a valve (e.g., a flow control valve) is used to adjust the flow rate of fluid through the conduit, such as by adjusting an opening within the conduit through which the fluid is directed. Thus, the valve adjusts the flow rate of fluid directed into the pumping chamber of the second cylinder 18B. For example, the valve may be adjusted for various operating modes that may include different rates of powdered material to be directed and, therefore, demand different corresponding flow rates of fluid to be directed into the pumping chambers to aerate the powdered material.

Figure 6:
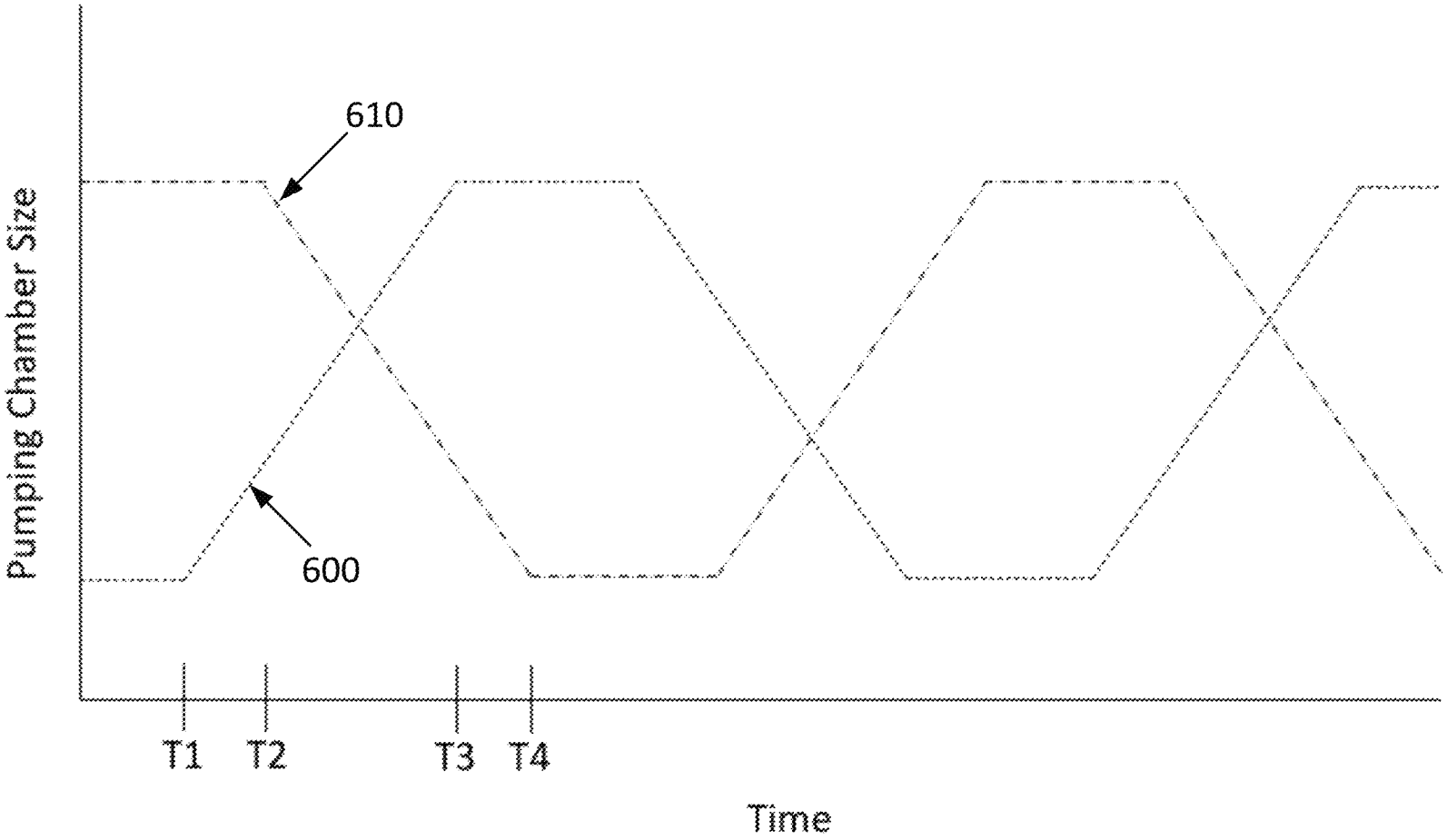
FIG. 6 is a graph illustrating timing of piston strokes for a pump drive system, in accordance with an embodiment of the present disclosure.

FIG. 6 is a graph illustrating movement of different pistons within their respective cylinders. In particular, a first line 600 corresponds to movement of a first piston within a first cylinder (e.g., the first cylinder 18A), and a second line 610 corresponds to movement of a second piston within a second cylinder (e.g., the second cylinder 18B). A conduit system is configured to direct fluid from the containment chamber 81 of the first cylinder 18A to the pumping chamber 46 of the second cylinder 18B to aerate powdered material in the pumping chamber 46 of the second cylinder 18B. The lines 600 and 610 indicate a size of the pumping chamber in the respective cylinders resulting from movement of the pistons therein. For example, a decrease in the value of a line is associated with decreasing a volume in the pumping chamber and, therefore, indicates a stroke of the piston to discharge powdered material in the particular cylinder. An increase in the value of a line is associated with increasing the volume in the pumping chamber and, therefore, indicates a stroke of the piston to draw powdered material in the particular cylinder. An increase of a line is also associated with decreasing the volume in the containment chamber 81 to discharge fluid from the containment chamber 81.

The illustrated graph shows that the first line 600 begins to increase at T1, whereas the second line 610 begins to decrease at T2, which occurs after T1. That is, the first piston begins to move to increase the size of the pumping chamber 46 of the first cylinder 18A and to decrease the size of the containment chamber 81 of the first cylinder 18A before the second piston begins to move to decrease the size of the pumping chamber 46 of the second cylinder 18B. Accordingly, the first piston begins to discharge fluid from the containment chamber 81 of the first cylinder 18A as a result of the decrease in the size of the containment chamber 81 of the first cylinder 18A before the second piston begins to discharge powdered material from the pumping chamber 46 of the second cylinder 18B as a result of the decrease in the size of the pumping chamber 46 of the second cylinder 46. As such, by the time the second piston moves to discharge powdered material, the powdered material is sufficiently aerated by the fluid. In other words, a piston of one cylinder moves to direct fluid into the pumping chamber 46 of another cylinder prior to the piston of the other cylinder moving to discharge powdered material from the pumping chamber 46 to readily enable increased movement of the powdered material. Consequently, the timing of movement (e.g., an intake stroke) of the first piston relative to the movement (e.g., a discharge stroke) of the second piston helps improve operation of a pump drive system.

It should be noted that the first line 600 stops increasing at time T3 and the second line 610 stops decreasing at a time T4, which occurs after T3. For example, a first duration of time in which the first line 600 increases may be substantially similar to a second duration of time in which the second line 610 decreases. That is, movement of the first piston to increase the size of the pumping chamber 46 of the first cylinder 18A takes about as long as movement of the second piston to decrease the size of the pumping chamber 46 of the second cylinder 18B. However, it should be noted that a duration of time in which the first piston moves to increase the size of the pumping chamber 46 of the first cylinder 18A may be greater than or less than that in which the second piston moves to decrease the size of the pumping chamber 46 of the second cylinder 18B in alternative embodiments. In any case, the termination of the increase of the first line 600 prior to the termination of the decrease of the second line 610 indicates that the fluid flow from the containment chamber 81 of the first cylinder 18A to the pumping chamber 46 of the second cylinder 18B is suspended prior to completed movement of the second piston to discharge powdered material from the pumping chamber 46 of the second cylinder 18B. However, the powdered material in the pumping chamber 46 of the second cylinder 18B may remain aerated for a duration of time after fluid flow into the pumping chamber 46 of the second cylinder 18B has been suspended. Therefore, despite fluid flow into the pumping chamber 46 of the second cylinder 18B being suspended prior to completed movement of the second piston to discharge powdered material, the second piston may still effectively discharge powdered material from the pumping chamber 46 after T3 (e.g., until movement of the second piston is completed at T4).

Alternatively, in other embodiments, other timing schemes may be utilized. For example, aeration of a pumping chamber may occur simultaneously with start of a powder discharge stroke or after the start of a powder discharge stroke. The timing scheme may also shift over the course of a pumping operation if desired. Still further, while FIG. 6 illustrates two cylinders, the timing sequence of FIG. 6 or variations thereof described herein may be applied to pumps with any number of chambers, with identical sequences applied across all cylinders, and/or with different timing sequences used between different pairs of cylinders (and/or changing over time). Indeed, the timing scheme between one pair of the cylinders may be different from the timing scheme between another pair of the cylinders implemented in the same pump drive system.

Figure 7:
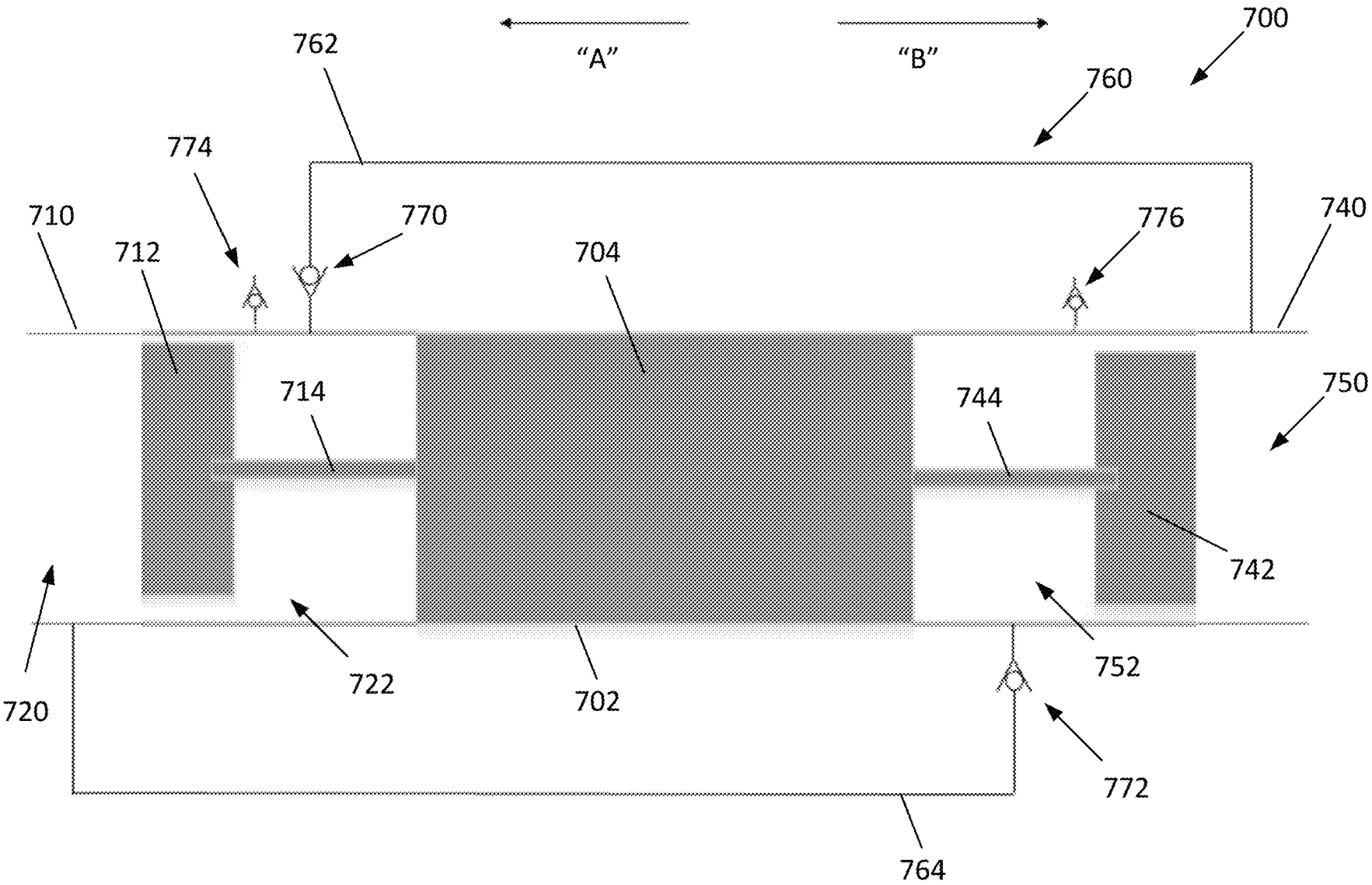
FIG. 7 is a schematic diagram of a pump drive system, in accordance with an embodiment of the present disclosure.

The techniques discussed herein may also be implemented in other configurations of pump drive systems, such as a different pump drive system having a different arrangement of cylinders and pistons. For example, FIG. 7 is a schematic diagram of pump system (e.g., a diaphragm pump or another suitable type of pump system) 700 that includes a first cylinder 710 and a second cylinder 740. A first piston 712 is disposed in and configured to move (e.g., translate) within the first cylinder 710, and a second piston 742 is disposed in and configured to move (e.g., translate) within the second cylinder 740. For example, the first piston 712 defines a first pumping chamber 720 and a first containment chamber 722 in the first cylinder 710, and the second piston 742 defines a second pumping chamber 750 and a second containment chamber 752 in the second cylinder 740. Movement of the first piston 712 within the first cylinder 710 adjusts a size of the first pumping chamber 720 and of the first containment chamber 722, and movement of the second piston 742 within the second cylinder 740 adjusts a size of the second pumping chamber 750 and of the second containment chamber 752.

In the illustrated embodiment, the first piston 712 is coupled to a driver 704 via a first rod 714, and the second piston 742 is coupled to the driver 704 via a second rod 744. The driver 704 is configured to move within a housing 702 to drive corresponding movement of the first piston 712 and of the second piston 742. For example, movement of the driver 704 in a first direction "A" may move the first piston 712 and the second piston 742 in the first direction "A" to reduce the sizes of the first pumping chamber 720 and the second containment chamber 752 while increasing the sizes of the first containment chamber 722 and the second pumping chamber 750. Thus, movement of the driver 704 in the first direction "A" may cause the first piston 712 to discharge powdered material from the first pumping chamber 720 while also causing the second piston 742 to draw powdered material into the second pumping chamber 750. Movement of the driver 704 in a second direction "B", opposite the first direction "A", may move the first piston 712 and the second piston 742 in the second direction "B" to increase the sizes of the first pumping chamber 720 and the second containment chamber 752 while reducing the sizes of the first containment chamber 722 and of the second pumping chamber 750. As such, movement of the driver 704 in the second direction "B" may cause the second piston 742 to discharge powdered material from the second pumping chamber 750 while also causing the first piston 712 to draw powdered material into the first pumping chamber 720. The driver 704 may reciprocate to alternate movement between the first direction "A" and the second direction "B".

The pump drive system 700 also includes a conduit system 760 having a first conduit 762 and a second conduit 764. The first conduit 762 is fluidly coupled to the first containment chamber 722 and the second pumping chamber 750, and the second conduit 764 is fluidly coupled to the first pumping chamber 720 and the second containment chamber 752. As such, movement of the first piston 712 in the second direction "B" causes fluid to flow through the first conduit 762, from the first containment chamber 722 to the second pumping chamber 750, and aerate powdered material in the second pumping chamber 750. On the other hand, movement of the second piston 742 in the first direction "A" causes fluid to flow through the second conduit 764, from the second containment chamber 752 to the first pumping chamber 720, and aerate powdered material in the first pumping chamber 720. Therefore, reciprocating motion of the driver 704 alternately pumps powdered material from the first pumping chamber 720 and the second pumping chamber 750 while also alternately moving fluid into the first pumping chamber 720 and the second pumping chamber 750 to aerate powdered material in the cylinders 710 and 740. Consequently, the pump drive system 700 may more effectively and efficiently pump powdered material.

In the depicted embodiment, a first one-way valve (e.g., a first check valve) 770 is configured to block fluid flow from the second pumping chamber 750 to the first containment chamber 722. To this end, the first one-way valve 770 is positioned between the second pumping chamber 750 and the first containment chamber 722, such as adjacent to the first containment chamber 722 or adjacent to the second pumping chamber 750. Meanwhile, a second one-way valve (e.g., a second check valve) 772 is configured to block fluid flow from the first pumping chamber 720 to the second containment chamber 752. To this end, the second one-way valve 772 is positioned between the first pumping chamber 720 and the second containment chamber 752, such as adjacent to the first pumping chamber 720 or adjacent to the second containment chamber 752. With these one-way valves 770 and 772, the powdered material being pumped may not contaminate or clog the containment chambers 722 and 752 or the conduit system 760. However, other embodiments might also achieve similar advantages with various quantities of check valves.

Furthermore, a third one-way valve (e.g., a third check valve) 774 is configured to block fluid flow from the first containment chamber 722 into a surrounding environment while allowing fluid flow from the surrounding environment into the first containment chamber 722. Additionally, a fourth one-way valve (e.g., a fourth check valve) 776 is configured to block fluid flow from the second containment chamber 752 into the surrounding environment while allowing fluid flow from the surrounding environment into the second containment chamber 752. With these one-way valves, respective discharge strokes that increase the volume of the first containment chamber 722 and of the second containment chamber 752 direct fluid flow into the containment chambers 722 and 752 and enable fluid flow via the conduit system 760.

Still referring to FIG. 7, the illustrated pump drive system 700 includes two cylinders 710 and 740 in which each conduit is fluidly coupled to the cylinders. However, the pump drive system may include any suitable quantity of cylinders (e.g., multiple pairs of cylinders coupled to respective drivers) and/or the conduit system may include conduits that fluidly couple to cylinders in a different manner (e.g., a conduit is fluidly coupled to cylinders of different pairs, such as a daisy-chain arrangement) in additional or alternative embodiments. In such embodiments, movement of the respective pistons in the cylinders drives fluid flow between cylinders to aerate material in different cylinders to facilitate pumping of powdered material.

Figure 8:
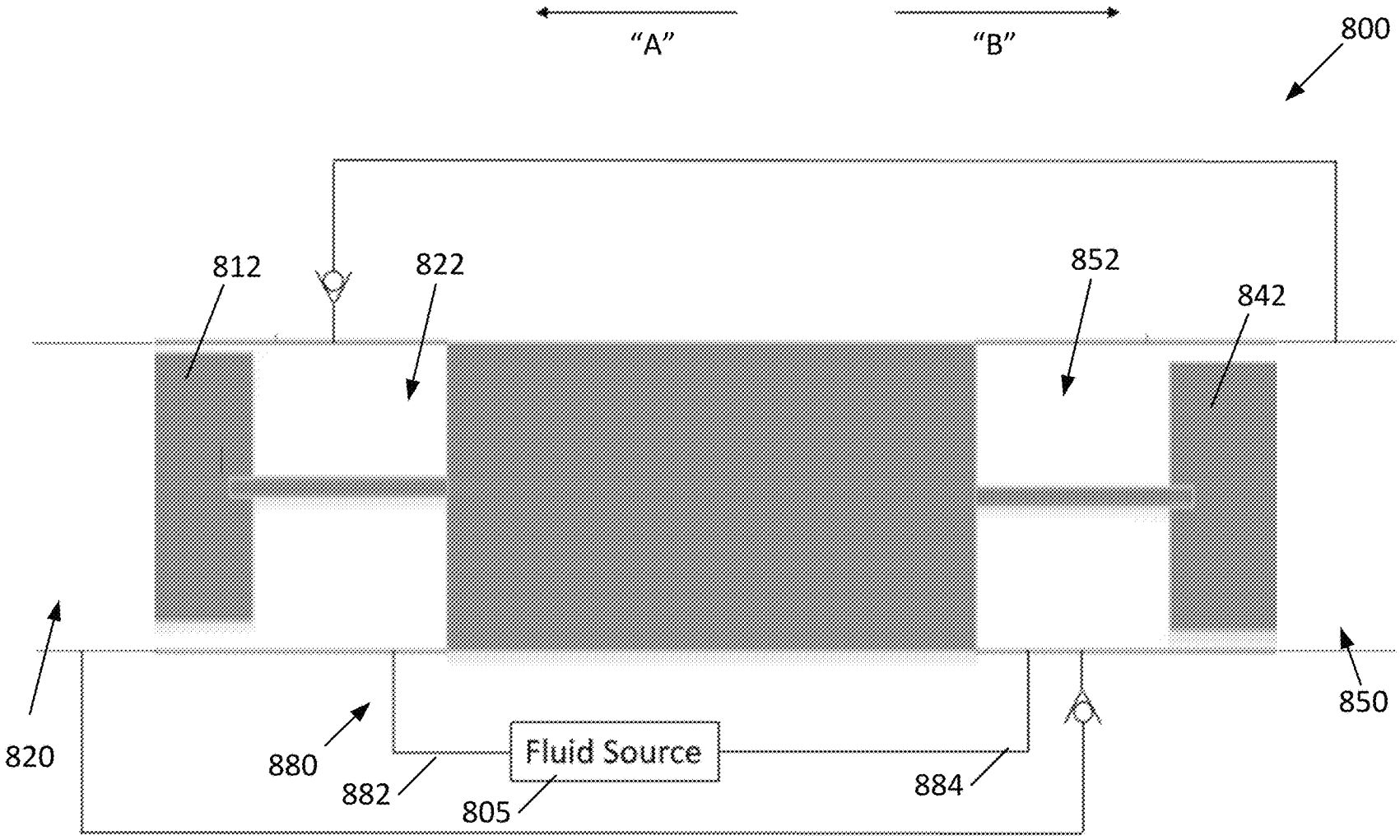
FIG. 8 is a schematic diagram of a pump drive system, in accordance with an embodiment of the present disclosure.

FIG. 8 is a schematic diagram of a pump drive system 800 which includes several similar structural features to pump system 700. Pump drive system 800 includes a fluid source (e.g., a tank, a reservoir) 805 that is fluidly coupled to a first containment chamber 822 and to a second containment chamber 852. The fluid source 805 is configured to store a fluid (e.g., air, nitrogen), such as low pressure fluid, and direct fluid into the containment chambers 822 and 852 via a conduit system 880 (e.g., a first conduit 882 fluidly coupling the first containment chamber 822 and the fluid source 805 to one another, and a second conduit 884 fluidly coupling the second containment chamber 852 and the fluid source 805 to one another). For instance, the fluid source 805 may be configured to fill the containment chambers 822 and 852 with fluid such that movement of pistons 812 and 842 to reduce the size of the containment chambers 822 and 852, respectively, may readily discharge fluid from the containment chambers 822 and 852 to a corresponding pumping chamber 820 or 850. Thus, the fluid source 805 facilitates sufficient fluid flow into the pumping chambers 820 and 850 to aerate powdered material and improve operation of the pump drive system 800 to discharge powdered material.

In some embodiments, the fluid source 805 includes a pump configured to direct air (e.g., ambient air) from the surrounding environment of the pump drive system 800 into the containment chambers 822 and 852. In additional or alternative embodiments, the fluid source 805 includes a tank or reservoir that stores fluid separate from air in the surrounding environment, and the fluid source directs fluid from the tank into the containment chambers 822 and 852.

Figure 9:
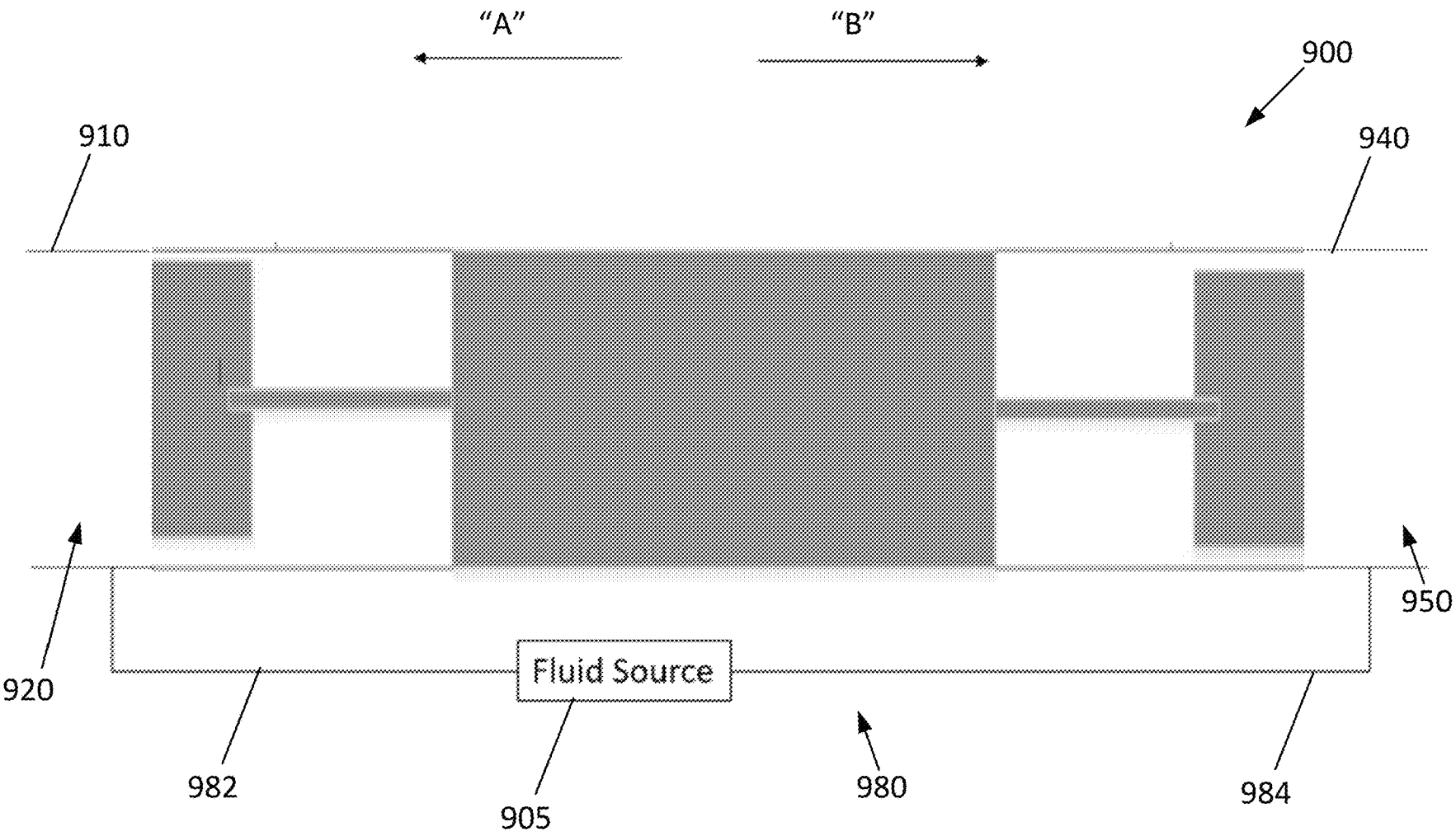
FIG. 9 is a schematic diagram of a pump drive system, in accordance with an embodiment of the present disclosure.

FIG. 9 is a schematic diagram of another pump system 900 in which a fluid source 905 is fluidly coupled to the first pumping chamber 920 and to the second pumping chamber 950. The fluid source 905 is configured to supply fluid directly into the pumping chambers 920 and 950 via a conduit system 980, such as a first conduit 982 fluidly coupling the fluid source 905 to the first pumping chamber 920 and a second conduit 984 fluidly coupling the fluid source 905 to the second pumping chamber 950. Thus, fluid may be directed into cylinders 910 and 940 to aerate powdered material without having to pass fluid between the cylinders 910 and 940. In certain embodiments, the fluid source may direct fluid at particular time intervals, such as near or during respective discharge strokes to aerate the powdered material and facilitate pumping of powdered material.

Figure 10:
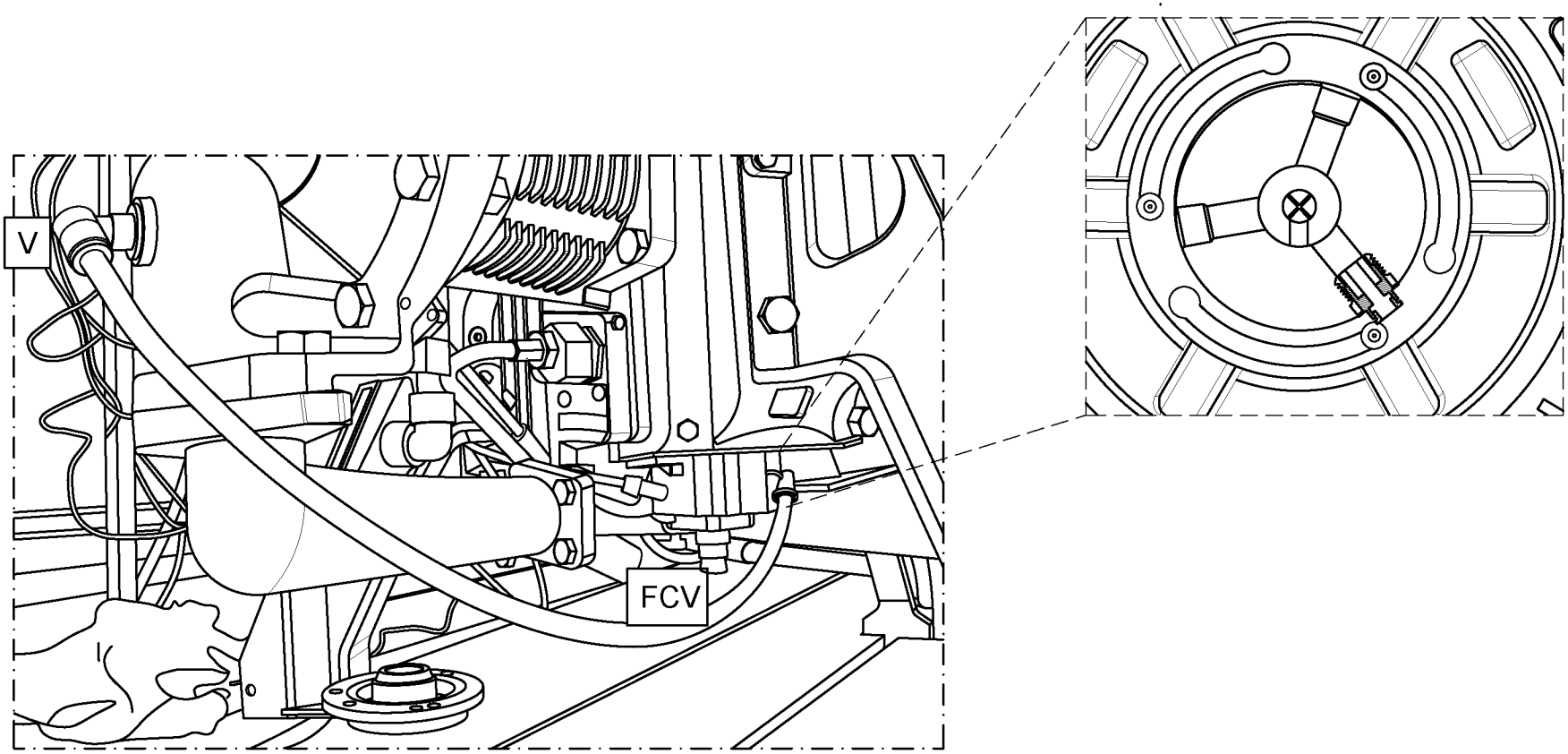
FIG. 10 illustrates a pump drive system that includes a distributor for directing fluid into cylinders, in accordance with an embodiment of the present disclosure.

FIG. 10 includes a perspective view of a pump system that includes a fluid source configured to store and output a fluid (e.g., air, nitrogen). The pump system also includes a distributor (e.g., a pneumatic distributor) coupled to a crankcase and configured to enable fluid flow from the fluid source into the pumping chambers at particular time intervals, such as near or during respective discharge strokes. By way of example, the distributor may include a first component (e.g., a stator) having supply channels, and each supply channel is fluidly coupled to a respective pumping chamber via the conduit system, such as by connecting each supply channel to a respective conduit using a connector disposed in or coupled to the distributor. The distributor may also include a second component (e.g., a rotor) with an inlet channel fluidly coupled to the fluid source, as well as a passage fluidly coupled to the inlet channel. The fluid source may be pressurized and therefore configured to fill the inlet channel and the passage of the second component with fluid.

However, the second component moves relative to the first component to alternately enable and block fluid flow from the passage through the different supply channels and into the pumping chambers. For instance, the second component may be coupled to the crankshaft of the pump system and therefore configured to sequence movement to adjust positioning of the passage relative to each supply channel. Alignment of the passage with a supply channel enables fluid flow from the fluid source through the supply channel and into the corresponding pumping chamber. Misalignment of the passage with a supply channel (e.g., the passage is aligned with another supply channel, the passage is aligned with a wall of the first component) blocks fluid flow from the fluid source through the supply channel. Therefore, the corresponding pumping chamber does not receive fluid from the fluid source. As such, sequential movement of the second component, such as rotation thereof, as driven by rotation of the crankshaft, may selectively supply fluid to the pumping chambers, such as at the particular time intervals to improve pumping of powdered material. In alternative embodiments, the sequential movement of the second component can be a movement other than rotation.

The first component may also be rotated relative to the crankcase to move the supply channels relative to the second component and change the timing in which fluid is directed into the pumping chambers. For example, in a first orientation of the first component (e.g., a first rotational position of the first component relative to the crankcase), a first rotational position of the second component aligns the passage with the supply channel configured to direct fluid into a pumping chamber of a cylinder. The first rotational position of the second component may correspond to a first rotational position of the crankshaft at which movement of a piston to discharge powdered material from the pumping chamber of the cylinder is initiated. Thus, in the first orientation of the first component, the second component is configured to direct fluid from the fluid source into the pumping chamber of the cylinder as the crankshaft initiates movement of the piston to discharge powdered material from the pumping chamber.

However, in a second orientation of the first component (e.g., a second rotational position of the first component relative to the crankcase), the first rotational position of the second component no longer aligns the passage with the supply channel. As such, in the second orientation of the first component, the second component is not configured to direct fluid from the fluid source into the pumping chamber of the cylinder as the crankshaft initiates movement of the piston to discharge powdered material from the pumping chamber. Instead, in the second orientation of the first component, a second rotational position of the second component aligns the passage with the supply channel. The second rotational position of the second component may correspond to a second rotational position of the crankshaft that is in place prior to initiation of the movement of the piston to discharge powdered material from the pumping chamber (i.e., the piston does not move to discharge powdered material from the pumping chamber until the crankshaft has moved from its second rotational position to its first rotational position). Therefore, in the second orientation of the first component, the second component is configured to direct fluid from the fluid source into the pumping chamber of the cylinder before the crankshaft initiates movement of the piston to discharge powdered material from the pumping chamber (e.g., to preemptively aerate the powdered material such that the powdered material may be moved more easily upon initiating movement of the piston to discharge powdered material). Accordingly, the first component may be rotated and positioned to change the timing of when fluid is directed into the pumping chamber relative to movement of the piston.

Although the passages of the distributor are uniformly distributed around a rotational axis of the first component (i.e., the respective angles formed between each adjacent passage are equal to one another) in the illustrated embodiment, in alternative embodiments, the passages may not be uniformly distributed around the rotational axis. For instance, a passage may be more adjacent to one of the other passages than to another of the passages. In other words, the respective angles formed between each adjacent passage may be different form one another (e.g., a first angle formed between a first passage and a second passage is greater than a second angle formed between the first passage and a third passage. Such distribution of the passages may adjust a timing in which fluid is directed into each cylinder (e.g., to correspond more suitably to movement of the respective pistons within the cylinders).

To enable rotation of the first component relative to the crankcase, the first component includes slots or openings. A fastener is inserted through each slot to fix to the crankcase and secure the first component to the crankcase. In addition, the slots enable the first component to rotate relative to the fastener and therefore relative to the crankcase. For example, the fastener may be loosened to reduce compression of the first component against the crankcase and enable movement of the first component relative to the crankcase, and the fastener may be tightened to compress the first component securely against the crankcase and block movement of the first component relative to the crankcase, thereby securing the orientation of the first component. As such, the timing of directing fluid into the pumping chamber may be readily adjusted (e.g., manually adjusted) and set (e.g., manually set) as desired. Although the distributor is configured to direct fluid into the pumping chambers via a rotating mechanism in the illustrated embodiment, the distributor may direct fluid into the pumping chambers using any other suitable mechanism in additional or alternative embodiments.

A size of the passage and/or of the supply channels may establish a flow rate of fluid directed into the various pumping chambers. For instance, to provide fluid at different flow rates into the pumping chambers, the distributor may be manufactured to have supply channels with different sizes. Additionally or alternatively, a valve (e.g., a flow control valve) disposed in or at the conduit may control flow rate directed into a pumping chamber. By way of example, the valve may be adjustable to readily increase or decrease the flow rate, such as regardless of the manufactured size of the supply channels. In further embodiments, the fluid source may be operated to control the flow rate directed into the distributor and toward the pumping chambers, such as to adjust the flow rate of fluid discharged by the fluid source to adjust the flow rate of fluid directed into each pumping chamber.

One or more one-way valves (e.g., a respective one-way valve for each supply channel) may also be implemented to block fluid flow from the pumping chambers toward the distributor. For instance, the one-way valves may be positioned between the distributor and the pumping chambers, such as along the conduits, at the distributor, and/or at the pumping chamber. Thus, undesirable fluid flow into the distributor (e.g., and toward the fluid source) may be avoided, such as during operation of the pump system during which the pumping chambers are pressurized and/or upon suspending operation of the pump system during which the fluid source does not operate to direct fluid into the pumping chambers.

Moreover, in certain embodiments, the containment chamber of each cylinder is fluidly coupled to a surrounding environment to enable fluid flow between the containment chambers to the and the surrounding environment. For instance, a discharge stroke that increases the volume of the containment chamber may direct fluid into the containment chamber from the surrounding environment, and a suction stroke that reduces the volume of the containment chamber may discharge fluid from containment chamber into the surrounding environment. Additionally or alternatively, the containment chamber of each cylinder is fluidly coupled to one another. Consequently, fluid may be transferred between containment chambers of different cylinders. That is, a suction stroke that reduces the volume of a containment chamber discharges fluid from the containment chamber to another containment chamber, and a discharge stroke that increases the volume of a containment chamber directs fluid from another containment chamber into the containment chamber. In either case, fluid flow into and out of the containment chambers reduce or limit undesirable pressure levels within the containment chamber that otherwise would impede movement of the pistons. Consequently, the pistons move more easily and readily to direct powdered material.

Although the distributor is incorporated into the pump system that moves pistons within corresponding cylinders via a crankshaft in the illustrated embodiment, the distributor may be incorporated in a pump system (e.g., any of the pump systems shown in FIGS. 7-9) that utilizes a reciprocating shaft that moves multiple pistons in an alternating manner in other embodiments. Indeed, the distributor or any other suitable timing mechanism may be incorporated into any of the pump systems disclosed herein to adjust fluid flow directed into the pumping chamber of different pistons relative to one another.

Figure 11:
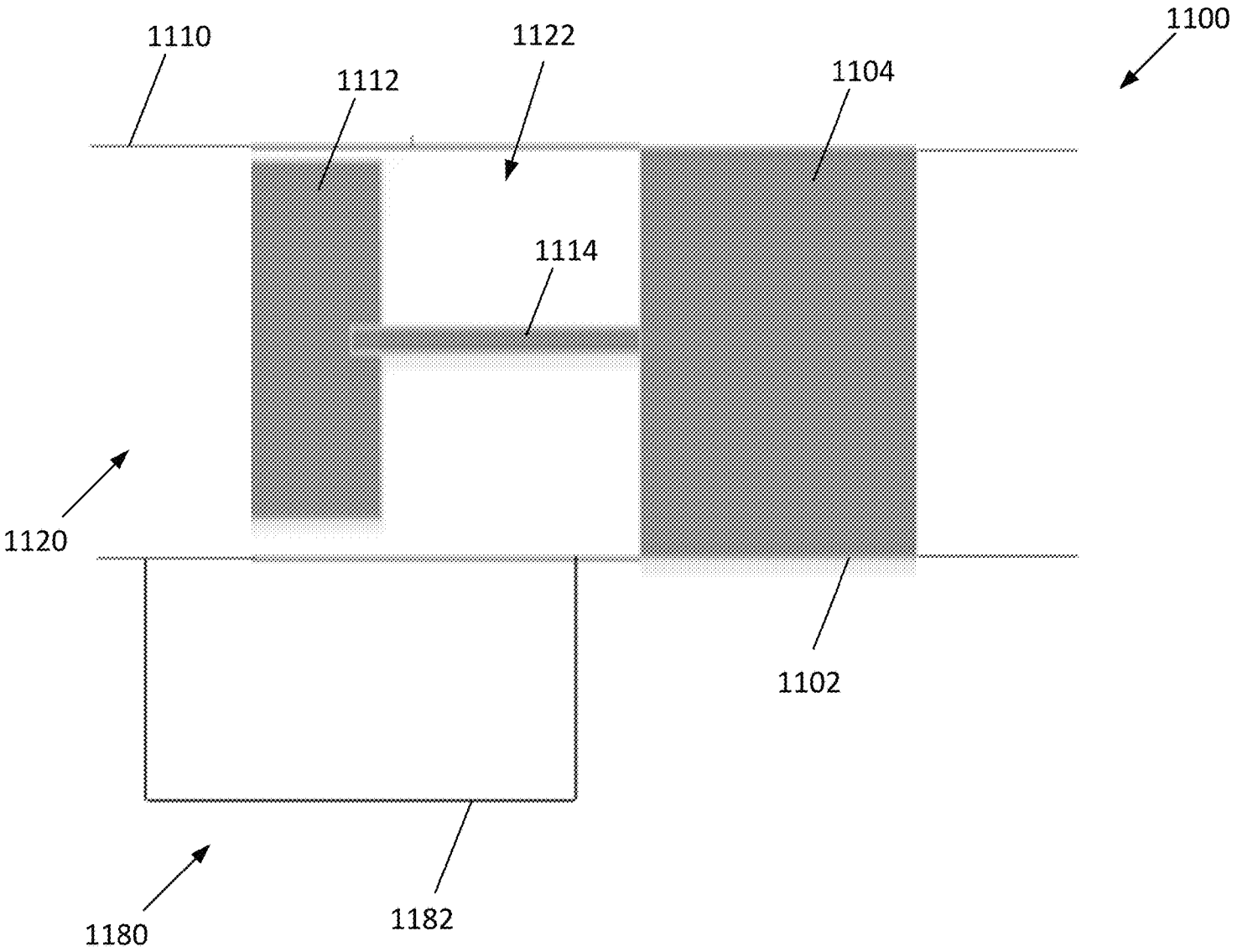
FIG. 11 is a schematic diagram of a pump drive system, in accordance with an embodiment of the present disclosure.

FIG. 11 is a schematic diagram of a pump system (e.g., a diaphragm pump or another suitable type of pump system) 1100 that includes a single cylinder 1110. A piston 1112 is disposed in and configured to move (e.g., translate) within the cylinder 1110 to define a pumping chamber 1120 and a containment chamber 1122 in the cylinder 1110. The piston 1112 includes one or more diaphragms that define the pumping chamber 1120 and the containment chamber 1122 in the cylinder 1110. Movement of the piston 1112 within the cylinder 1110 adjusts a size of the pumping chamber 1120 and of the containment chamber 1122. The piston 1112 is coupled to a driver 1104 via a rod 1114, and the driver 1104 is configured to move within a housing 1102 to drive corresponding movement of the piston 1112. For example, movement of the driver 1104 in a first direction may move the piston 1112 in the first direction to reduce a size of the pumping chamber 1120 while increasing a size of the containment chamber 1122. Thus, movement of the driver 1104 in the first direction may cause the piston 1112 to discharge powdered material from the pumping chamber 1120. Movement of the driver 1104 in a second direction, opposite the first direction, may move the piston 1112 in the second direction to increase the size of the pumping chamber 1120 while reducing the size of the containment chamber 1122. As such, movement of the driver 1104 in the second direction may cause the piston 1112 to draw powdered material into the pumping chamber 1122.

The pump drive system 1100 also includes a conduit system 1180 having a conduit 1182 fluidly coupled to the containment chamber 1122 and the pumping chamber 1120. As such, movement of the piston 1112 in the second direction causes fluid to flow through the conduit 1182, from the containment chamber 1122 to the pumping chamber 1120, and aerate powdered material in the pumping chamber 1120. On the other hand, movement of the piston 1112 in the first direction causes fluid to flow through the conduit 1182, from the pumping chamber 1120 to the containment chamber 1122, and replenish fluid to the containment chamber 1122. Therefore, reciprocating motion of the drive 1104 alternately directs fluid between the containment chamber 1122 and the pumping chamber 1120.

Figure 12:
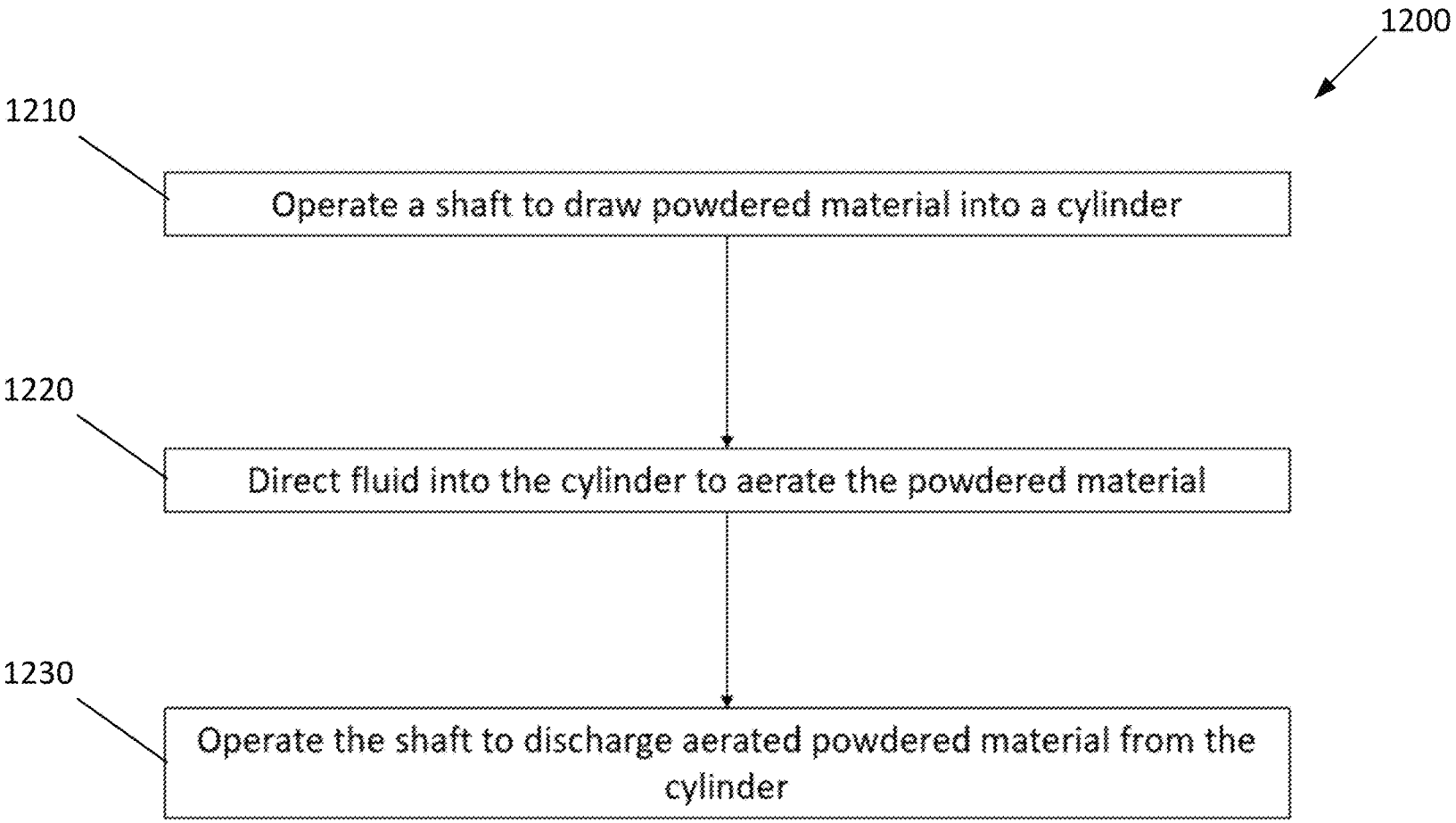
FIG. 12 is a schematic diagram of a method for operating a pump system, in accordance with an embodiment of the present disclosure.

FIG. 12 is a flowchart 1200 of a method for operating a pump system, such as any of the pump systems discussed herein. The pump system includes a cylinder and a piston disposed in the cylinder to define a pumping chamber and a containment chamber in the cylinder. In some embodiments, a single entity (e.g., the external controller 11) may perform the operations of the method. In additional or alternative embodiments, the operations of the method may be performed by separate entities. It should also be noted that the method may be performed differently than depicted. For example, an additional operation may be performed, and/or any of the depicted operations may be performed differently, in a different order, and/or not be performed.

In step 1210, a shaft operates to draw powdered material into the cylinder. That is, the shaft drives the piston to increase a size of the pumping chamber to enable intake of powdered material. In some embodiments, the shaft may rotate about an axis to drive movement of the piston. Alternatively, the shaft may translate to drive movement of the piston.

In step 1220, a fluid is directed into the pumping chamber of the cylinder to aerate the powdered material, thereby preventing or at least discouraging settling of the powdered material in the pumping chamber. In certain embodiments, fluid is directed from a containment chamber of an additional cylinder into the pumping chamber of the cylinder via a conduit system. For example, movement of the shaft to drive the piston to increase a size of the pumping chamber may drive an additional piston of the additional cylinder to reduce a size of the containment chamber of the additional cylinder to direct fluid from the containment chamber of the additional cylinder into the pumping chamber of the cylinder. Additionally or alternatively, a fluid source is configured to direct fluid directly into the pumping chamber via the conduit system. For instance, a distributor may move to enable fluid flow from the fluid source to the pumping chamber. In either case, fluid may be directed into the cylinder before powdered material is discharged from the pumping chamber and/or while powdered material is drawn into the pumping chamber (e.g., during movement of the piston within the cylinder to increase a size of the pumping chamber).

In step 1230, the shaft then operates to discharge aerated powdered material from the pumping chamber of the cylinder. The aerated powdered material may be more readily movable as compared to settled powdered material. As such, aeration of the powdered material may improve operation of the pump system to discharge powdered material.

In some embodiments, similar operations of the method may be performed for an additional cylinder. By way of example, operation of the shaft to drive movement of the piston to draw aerated powdered material into the pumping chamber of the cylinder may direct fluid from the containment chamber of the cylinder into an additional pumping chamber of the additional cylinder to aerate powered material in the additional pumping chamber. The shaft may then operate to drive movement of an additional piston in the additional cylinder to discharge aerated powdered material from the additional pumping chamber. Additionally or alternatively, the distributor may move to enable fluid flow from the fluid source to the additional pumping chamber of the additional cylinder. Such movement of the distributor may block fluid flow from the fluid source to the pumping chamber. As such, the distributor may alternately enable and block fluid flow to different pumping chambers.

As used herein, unless expressly stated to the contrary, use of the phrase 'at least one of', 'one or more of', 'and/or', variations thereof, or the like are open-ended expressions that are both conjunctive and disjunctive in operation for any and all possible combination of the associated listed items. For example, each of the expressions 'at least one of X, Y and Z', 'at least one of X, Y or Z', 'one or more of X, Y and Z', 'one or more of X, Y or Z' and 'X, Y and/or Z' can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Additionally, unless expressly stated to the contrary, the terms 'first', 'second', 'third', etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, 'first X' and 'second X' are intended to designate two 'X' elements that are not necessarily limited by any order, rank, importance, temporal sequence, or hierarchy of the two elements. Further as referred to herein, 'at least one of' and 'one or more of' can be represented using the '(s)' nomenclature (e.g., one or more element(s)).

Each example embodiment disclosed herein has been included to present one or more different features. However, all disclosed example embodiments are designed to work together as part of a single larger system or method. This disclosure explicitly envisions compound embodiments that combine multiple previously-discussed features in different example embodiments into a single system or method.

One or more advantages described herein are not meant to suggest that any one of the embodiments described herein necessarily provides all of the described advantages or that all the embodiments of the present disclosure necessarily provide any one of the described advantages. Numerous other changes, substitutions, variations, alterations, and/or modifications may be ascertained to one skilled in the art and it is intended that the present disclosure encompass all such changes, substitutions, variations, alterations, and/or modifications as falling within the scope of the appended claims.

What is claimed is:

1. A pump, comprising:

a first cylinder;

a first piston disposed within the first cylinder to define a first chamber and a second chamber within the first cylinder, wherein the first piston is configured to move within the first cylinder to reduce a size of the first chamber to discharge material from the first chamber;

a second cylinder;

a second piston disposed within the second cylinder to define a third chamber and a fourth chamber within the second cylinder, wherein the second piston is configured to move within the second cylinder to reduce a size of the third chamber to discharge material from the third chamber; and a conduit system configured to direct fluid into the first chamber to aerate material in the first chamber, wherein the conduit system fluidly couples the fourth chamber and the first chamber to one another and is configured to direct fluid from the fourth chamber to the first chamber to aerate material in the first chamber.

2. The pump of claim 1, wherein the second piston is configured to move within the second cylinder to reduce a size of the fourth chamber to draw material into the third chamber and to direct fluid from the fourth chamber to the first chamber via the conduit system.

3. The pump of claim 2, comprising a shaft configured to drive movement of the first piston within the first cylinder and movement of the second piston within the second cylinder, wherein the shaft is configured to drive movement of the second piston within the second cylinder to reduce the size of the fourth chamber to direct fluid from the fourth chamber to the first chamber via the conduit system prior to the first piston moving within the first cylinder to reduce the size of the first chamber to discharge material from the first chamber.

4. The pump of claim 1, comprising a crankshaft extending along a crankshaft axis and configured to rotate about the crankshaft axis during operation of the pump, wherein the first cylinder and the second cylinder are distributed circumferentially around the crankshaft axis, and rotation of the crankshaft drives movement of the first piston within the first cylinder and movement of the second piston within the second cylinder.

5. The pump of claim 4, wherein the first piston is configured to move within the first cylinder along a first cylinder axis, the second piston is configured to move within the second cylinder along a second cylinder axis, and the first cylinder axis and the second cylinder axis are offset from one another along the crankshaft axis.

6. The pump of claim 1, wherein the conduit system comprises a check valve configured to block fluid flow from the first chamber to the fourth chamber.

7. The pump of claim 1, comprising:

a third cylinder; and a third piston disposed within the third cylinder to define a fifth chamber and a sixth chamber within the third cylinder, wherein the third piston is configured to move within the third cylinder to reduce a size of the fifth chamber to discharge material from the fifth chamber, and the conduit system fluidly couples the second chamber and the fifth chamber to one another and is configured to direct fluid from the second chamber to the fifth chamber to aerate material in the fifth chamber.

8. The pump of claim 7, wherein the conduit system comprises:

a first conduit fluidly coupled to the first chamber and to the fourth chamber; and a second conduit fluidly coupled to the second chamber and to the fifth chamber.

9. The pump of claim 1, wherein the first cylinder comprises an inlet that introduces material into the first chamber, and the conduit system is configured to direct fluid to the first chamber adjacent to the inlet to aerate material received via the inlet.

10. The pump of claim 1, comprising a fluid source configured to direct fluid into the first chamber via the conduit system.

11. The pump of claim 10, comprising a distributor configured to alternately enable and block fluid flow from the fluid source to the first chamber via the conduit system.

12. The pump of claim 11, wherein the distributor comprises:

a first component comprising a supply channel fluidly coupled to the first chamber via the conduit system; and a second component comprising:

an inlet channel fluidly coupled to the fluid source; and a passage fluidly coupled to the inlet channel, wherein the second component is configured to rotate relative to the first component to adjust positioning of the passage relative to the supply channel, alignment of the passage with the supply channel enables fluid flow from the fluid source into the first chamber via the supply channel, and misalignment of the passage with the supply channel blocks fluid flow from the fluid source into the first chamber via the supply channel.

13. A pump, comprising:

a first cylinder having an inlet;

a first piston disposed within the first cylinder to define a first chamber and a second chamber within the first cylinder, the first piston being movable within the first cylinder to reduce a size of the first chamber to discharge material from the first chamber and to increase a size of the second chamber;

a second cylinder;

a second piston disposed within the second cylinder to define a third chamber and a fourth chamber within the second cylinder; and a conduit system that directs fluid into the first chamber to aerate material in the first chamber, wherein conduit system is configured to direct the fluid adjacent to the inlet, wherein the conduit system fluidly couples the fourth chamber and the first chamber to one another and is configured to direct fluid from the fourth chamber to the first chamber to aerate material in the first chamber.

14. The pump of claim 13, wherein the second piston is configured to move within the second cylinder to reduce a size of the third chamber to discharge material from the third chamber.

15. The pump of claim 14, wherein the second piston is configured to move within the second cylinder to reduce a size of the fourth chamber to draw material into the third chamber and to direct fluid from the fourth chamber to the first chamber via the conduit system.

16. The pump of claim 14, comprising:

a crankshaft extending along a crankshaft axis and configured to rotate about the crankshaft axis during operation of the pump, wherein the first cylinder and the second cylinder are distributed circumferentially around the crankshaft axis, and rotation of the crankshaft drives movement of the first piston within the first cylinder and movement of the second piston within the second cylinder.

17. The pump of claim 13, comprising a fluid source configured to direct fluid into the first chamber via the conduit system.

18. A pump, comprising:

a first cylinder;

a first piston disposed within the first cylinder to define a first chamber and a second chamber within the first cylinder, the first piston being configured to move within the first cylinder to reduce a size of the first chamber to discharge material from the first chamber and to increase a size of the second chamber;

a second cylinder;

a second piston disposed within the second cylinder to define a third chamber and a fourth chamber within the second cylinder, the second piston being configured to move within the second cylinder to reduce a size of the third chamber to discharge material from the third chamber and to increase a size of the fourth chamber; and a conduit system that fluidly couples the fourth chamber to the first chamber, wherein the conduit system is configured to direct fluid from the fourth chamber to the first chamber to aerate material in the first chamber.

19. The pump of claim 18, wherein the second piston is configured to draw material into the third chamber and to direct fluid from the fourth chamber to the first chamber via the conduit system when the second piston moves within the second cylinder to reduce the size of the fourth chamber.

* * * * *